US009601846B2

(12) United States Patent
Moser

(10) Patent No.: US 9,601,846 B2
(45) Date of Patent: Mar. 21, 2017

(54) TEMPORARY ELECTRICAL GROUNDING SYSTEM HAVING A MAGNETIC ASSEMBLY COOPERATING WITH A CONDUCTIVE PIPE TO BE GROUNDED

(71) Applicant: MAG-GROUND, INC., Wyomissing, PA (US)

(72) Inventor: Kandis L. Moser, Sinking Springs, PA (US)

(73) Assignee: Mag-Ground, Inc., Wyomissing, PA (US)

( * ) Notice: Subject to any disclaimer, the term of this patent is extended or adjusted under 35 U.S.C. 154(b) by 0 days.

(21) Appl. No.: 14/990,381

(22) Filed: Jan. 7, 2016

(65) Prior Publication Data

US 2016/0204528 A1 Jul. 14, 2016

Related U.S. Application Data

(60) Provisional application No. 62/101,175, filed on Jan. 8, 2015.

(51) Int. Cl.

| | |
|---|---|
| ***H01R 11/30*** | (2006.01) |
| ***H01R 13/60*** | (2006.01) |
| ***H01R 4/64*** | (2006.01) |
| ***H01R 11/22*** | (2006.01) |

(52) U.S. Cl.

CPC ..... *H01R 4/64* (2013.01); *H01R 11/22* (2013.01); *H01R 11/30* (2013.01)

(58) Field of Classification Search

CPC ..... H01R 13/648; H01R 13/652; H01R 13/65802; H01R 13/6205; H01R 11/30; H01R 13/60; H01R 4/38; H01R 4/64

USPC ..... 439/38–40, 100, 104, 108

See application file for complete search history.

(56) References Cited

U.S. PATENT DOCUMENTS

| | | | | |
|---|---|---|---|---|
| 3,594,681 A * | 7/1971 | Weiss | F21S 4/10 | 362/378 |
| 3,967,872 A * | 7/1976 | Mooney | H01R 4/64 | 174/78 |
| 4,623,204 A * | 11/1986 | Auclair | H01R 4/40 | 24/279 |

(Continued)

*Primary Examiner* — Chandrika Prasad

(74) *Attorney, Agent, or Firm* — McNees Wallace & Nurick LLC

(57) ABSTRACT

A system and apparatus for providing a temporary electrical bonding/grounding connection. The apparatus includes an electrically conductive cable having first and second ends. The first conductive coupling is electrically coupled to the first end of the cable and a first magnetic assembly. The magnet assembly includes multiple surfaces which cooperate with an arcuate surface of a first conductive member to be grounded, with respective surfaces of the multiple surfaces being configured to properly mount to respective arcuate surfaces of respective first conductive members having different radiuses of curvature. The first magnetic component is detachably and electrically coupled to the first conductive coupling. The first magnetic component is configured to be electrically and magnetically coupled to the first conductive member. A second conductive coupling is electrically coupled to the second end of the cable, the second conductive coupling configured to be detachably and electrically coupled to a second conductive member.

20 Claims, 6 Drawing Sheets

(56) References Cited

U.S. PATENT DOCUMENTS

| | | | | |
|---|---|---|---|---|
| 5,364,281 | A * | 11/1994 | Leto | H01R 4/643 403/378 |
| 6,659,800 | B1 * | 12/2003 | Wu | H01R 13/6599 439/607.11 |
| 6,910,899 | B1 * | 6/2005 | Daume | F16L 11/127 439/100 |
| 7,967,615 | B2 * | 6/2011 | Zacharevitz | H01R 13/648 439/100 |
| 2003/0094297 | A1 * | 5/2003 | Morrow | B29C 47/0023 174/505 |
| 2005/0128757 | A1 * | 6/2005 | Schneider | B60Q 1/2615 362/398 |
| 2010/0285674 | A1 * | 11/2010 | David | H01R 13/6205 439/39 |
| 2016/0190743 | A1 * | 6/2016 | Shelton | H01R 4/64 439/38 |

* cited by examiner

TEMPORARY ELECTRICAL GROUNDING SYSTEM HAVING A MAGNETIC ASSEMBLY COOPERATING WITH A CONDUCTIVE PIPE TO BE GROUNDED

FIELD OF THE INVENTION

The present invention is directed to a temporary electrical bonding or grounding system to protect utility workers and the like from stray electrical current. In particular, the invention is directed to temporary electrical bonding or grounding system which has at least one magnet which attaches to a pipe to provide electrical grounding to the area of a pipe on which work is being performed.

BACKGROUND OF THE INVENTION

Municipal water distribution systems are designed to provide water from a central distribution facility to individual service locations. In these systems, water is often pumped through pipes buried in the ground. These pipes often require maintenance and repair due to age, damage or other reasons. Repairing buried water pipes requires crewman to excavate the pipes and disconnect and reconnect pipe connections.

Some residential homes have electrical service that is grounded on the water pipes, which are often made of metal and therefore are electrically conductive. In these circumstances, there is occasionally stray electrical current passing through the pipes and the main distribution lines, as well as the junction between the two, a location known as a "curb stop." Service crews excavating pipes to repair, replace or update them must handle the exposed metal pipes and can be electrically shocked by the stray current traveling through the pipes.

While there are currently arcane grounding systems and procedures in place, the systems and procedures are difficult to implement and are not routinely followed. It would, therefore, be beneficial to provide a grounding system and components which are easy and effective to use. It would also be beneficial to provide a grounding system and components which can be easily transported and minimizes the time and effort to set up and take down the system.

SUMMARY OF THE INVENTION

An object of the bonding/grounding system of the present invention is to prevent any utility worker from getting shocked by stray electrical current, whether the stray electrical current is a result of grounding the electrical system to water pipes in a home, insufficient grounding of the home when constructed or the aging of our current infrastructure.

An object of the bonding/grounding system of the present invention is to prevent workers from being exposed to stray electrical current in metallic piping, the system comprising a temporary electrical bonding/grounding system which allows the stray electrical current to continue to pass through the temporary ground and bypass the area to be worked on.

An object of the present invention is to provide a magnet assembly for use with a temporary electrical bonding/grounding system, the magnet assembly comprising multiple surfaces which cooperate with an arcuate surface of a conductive member, with respective surfaces being used properly mount to arcuate surfaces of different radiuses of curvature.

An embodiment is directed to an apparatus for providing a temporary electrical bonding/grounding connection. The apparatus includes an electrically conductive cable having first and second ends. The first conductive coupling is electrically coupled to the first end of the cable and a first magnetic assembly. The magnet assembly includes multiple surfaces which cooperate with an arcuate surface of a first conductive member to be grounded, with respective surfaces of the multiple surfaces being configured to properly mount to respective arcuate surfaces of respective first conductive members having different radiuses of curvature. The first magnetic component is detachably and electrically coupled to the first conductive coupling. The first magnetic component is configured to be electrically and magnetically coupled to the first conductive member. A second conductive coupling is electrically coupled to the second end of the cable, the second conductive coupling configured to be detachably and electrically coupled to a second conductive member.

An embodiment is directed to a bonding/grounding system which prevents workers from being exposed to stray electrical current in conductive piping. The system includes an electrically conductive cable having first and second ends. A first conductive coupling of the conductive cable is configured to be electrically coupled to a magnetic assembly. The magnetic assembly includes a removable conductive post which is dimensioned to receive the first conductive coupling. The magnetic assembly is configured to be electrically and magnetically coupled to a first conductive member. A second conductive coupling of the conductive cable is configured to be electrically coupled to a second conductive surface. The temporary electrical bonding/grounding system allows stray electrical current in the conductive piping to pass through the conductive cable, the magnetic assembly, the first conductive coupling and the second conductive coupling to allow the stray electrical current to bypass an area of the conductive piping to be worked on.

An embodiment is directed to a bonding/grounding system which prevents workers from being exposed to stray electrical current in conductive piping. The system includes an electrically conductive cable having first and second ends. A first conductive member of the conductive cable is configured to be electrically coupled to a magnetic assembly. The magnetic assembly includes multiple surfaces which cooperate with an arcuate surface of a first conductive member to be grounded, with respective surfaces of the multiple surfaces being configured to properly mount to respective arcuate surfaces of respective first conductive members having different radiuses of curvature. The first magnetic component is detachably coupled to the first conductive coupling. The first magnetic component is configured to be electrically and magnetically coupled to the first conductive member. The magnetic assembly includes a removable post which can be positioned in different locations depending upon the orientation of the magnetic assembly relative to the first conductive surface. The post is dimensioned to receive the first conductive coupling. A second conductive member of the conductive cable is configured to be detachably and electrically coupled to a second conductive surface. The temporary electrical bonding/grounding system allows stray electrical current in the conductive piping to pass through the conductive cable, the magnetic assembly, the first conductive coupling and the second conductive coupling to allow the stray electrical current to bypass an area of the conductive piping to be worked on.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
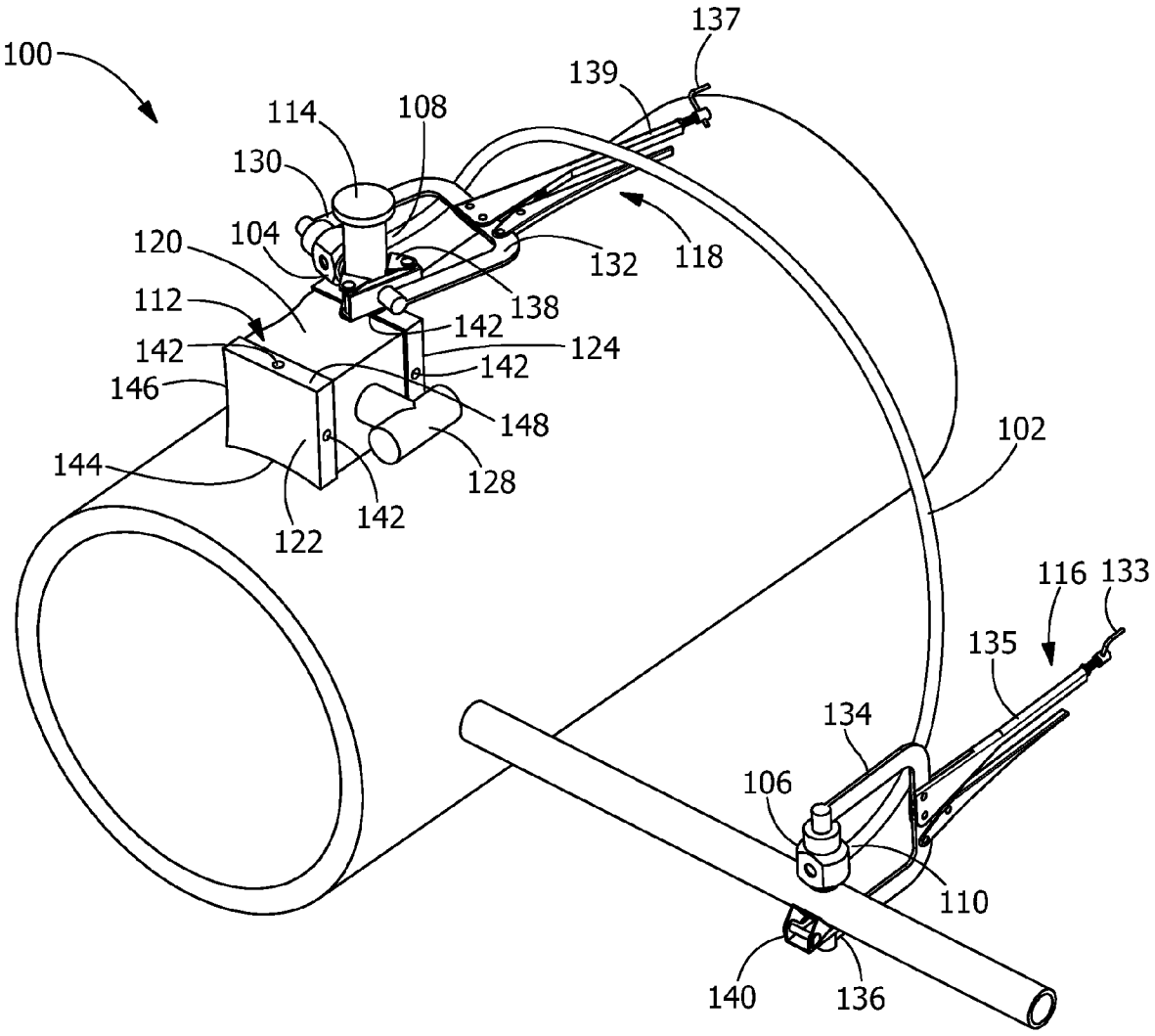
FIG. 1 illustrates a perspective view of an illustrative first embodiment of a temporary electrical bonding/grounding system of the present invention, the system which includes a magnetic component.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the preferred embodiments. Accordingly, the invention expressly should not be limited to such preferred embodiments illustrating some possible non-limiting combination of features that may exist alone or in other combinations of features, the scope of the invention being defined by the claims appended hereto.

Referring to FIG. 1, a first illustrative embodiment 100 of a temporary electrical bonding/grounding system is shown. The system allows stray electrical current to be circumvented or detoured around an area of a pipe to be repaired, thereby preventing electrical shock to the personnel repairing the pipe.

A first electrically conductive cable 102, having a first end 108 and a second end 110, is electrically coupled to a first conductive coupling 104 at the first end 108 and a second conductive coupling 106 at the second end 110. The first conductive coupling 104 is electrically coupled to a first magnetic assembly or component 112 using a first conductive member or magnet clamp 118 secured to a conductive mount or post 114. The post 114 is positioned on the first magnetic component 112 at one of a plurality of locations 142. The magnet clamp 118 includes a first half 130 and a second half 132 which are brought together when the magnet clamp 118 is closed, thereby electrically coupling and securing the magnet clamp 118 to the post 114. The first half 130 of the magnet clamp 118 retains the first conductive coupling 104, and the second half 132 of the magnetic clamp 118 retains a saddle 138, which work together to engage and retain the post 114 when the magnet clamp 118 is closed. The first magnetic component 112 includes a curved contour 144 that matches the curved contour of the pipe. The second conductive coupling 106 comprises a second conductive member or pipe clamp 116. The pipe clamp 116 includes a first half 134 and a second half 136. The first half 134 of the pipe clamp 116 retains the second conductive coupling 106 and the second half 136 of the pipe clamp 116 retains a pipe saddle 140. When the pipe clamp 116 is closed the first and second halves 134 and 136 are brought together to engage and secure a pipe.

Figure 2:
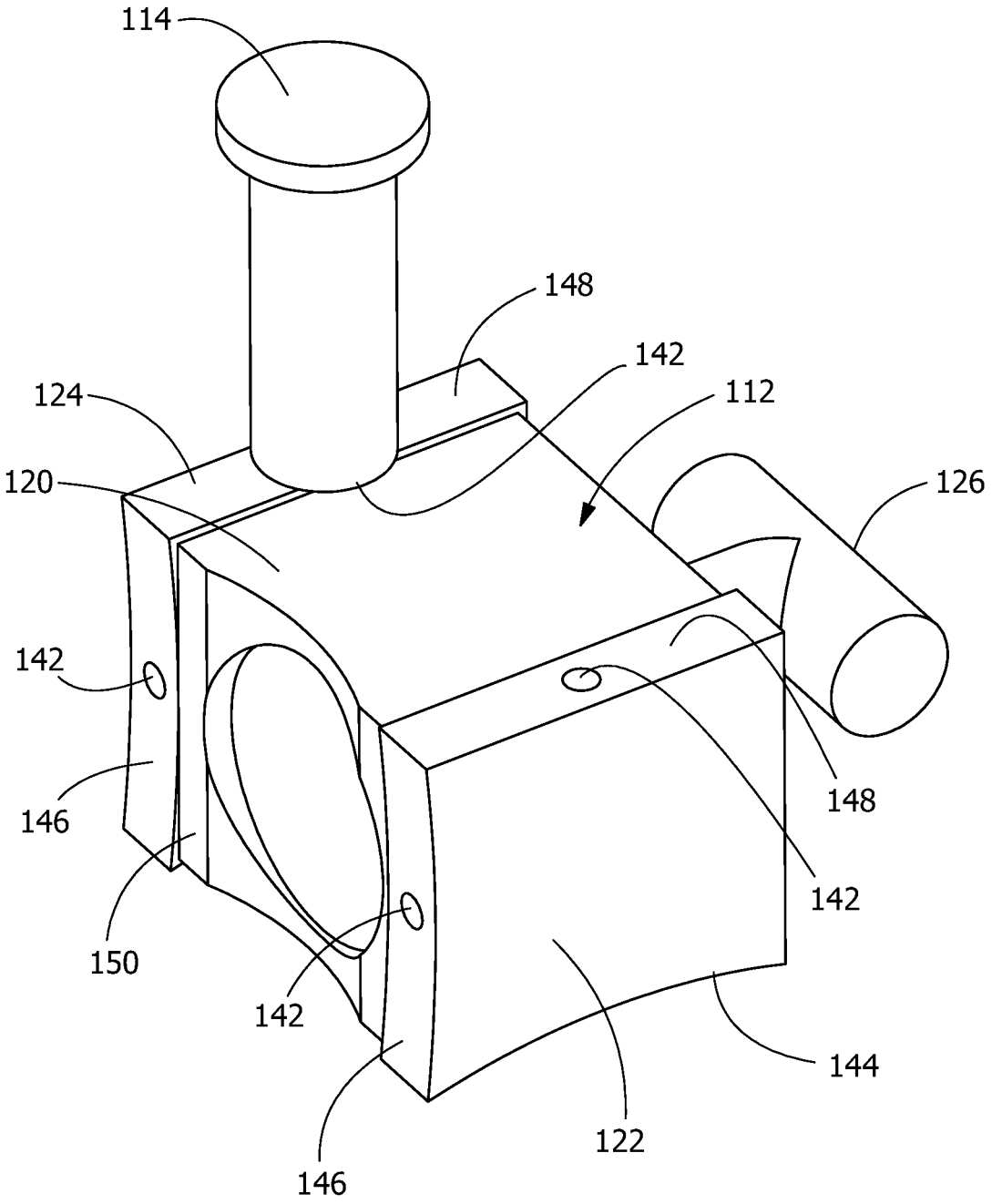
FIG. 2 illustrates a perspective view of an illustrative magnetic component used in the temporary electrical bonding/grounding system.

Referring to FIG. 2, the magnetic component 112 is shown. The magnetic component 112 includes a magnet 120, shoes 122, 124, a positioning handle 126 and the post 114 positioned at one of a plurality of locations 142 on the shoes 122, 124. Each of the shoes 122, 124 has a first curved surface 144, a second curved surface 146 and third curved surface 148. The first curved surfaces 144 of each of the shoes 122, 124 of the magnetic component 112 are positioned to extend in the same direction. The second curved surfaces 146 of each of the shoes 122, 124 of the magnetic component 112 are positioned to extend in the same direction, which is in a different direction than the first curved surfaces 144. The third curved surfaces 148 of each of the shoes 122, 124 of the magnetic component 112 are positioned to extend in the same direction, which is in a different direction than the first curved surfaces 144 and the second curved surface 146. The first, second and third curved surfaces 144, 146, 148 have different contours or radius of curvature, thereby allowing the first, second and third curved surfaces 144, 146, and 148 to engage and make electrical connection with different sized pipes or different pipe diameter ranges (such as, but not limited to, pipes greater than 2 inches, 4-8 inches, 10-12 inches, 16+ inches). For example, the third curved surface may be minimally curved or substantially flat to engage the side of a large diameter pipe. Any number or size of curved surfaces may be selected for the shoes 122, 124, based on the design needs. In the embodiment shown, the magnet 120 has generally planar sides, as the shoes 122, 124 are configured to accommodate the different diameters or sizes of the pipe. The shoes 122, 124 are made from material which is attracted to the magnet 120, thereby facilitating the physical and electrical connection between the shoes 122, 124 and the magnet 120. Alternatively, or in addition, the shoes 122, 124 may be fixed to the magnets 120 using known fastening means, such as, but not limited to, bolts.

In the illustrative embodiment shown, the locations 142 are openings provided on the shoes 122, 124. The positioning of the openings 142 may vary depending upon the configuration of the shoes 122, 124. In order to facilitate ease of operation, openings 142 are positioned to multiple side surfaces of the shoe 122, 124. This allows for the proper insertion of the post 114 into a respective opening 142, regardless of which of the curved surface 144, 146, 148 is placed in engagement with the pipe. While threaded openings 142 are shown, the locations may be other types of openings or surface which can maintain the post 114 in position and provide the required electrical connection between the post 114 and the shoes 122, 124.

Figure 3:
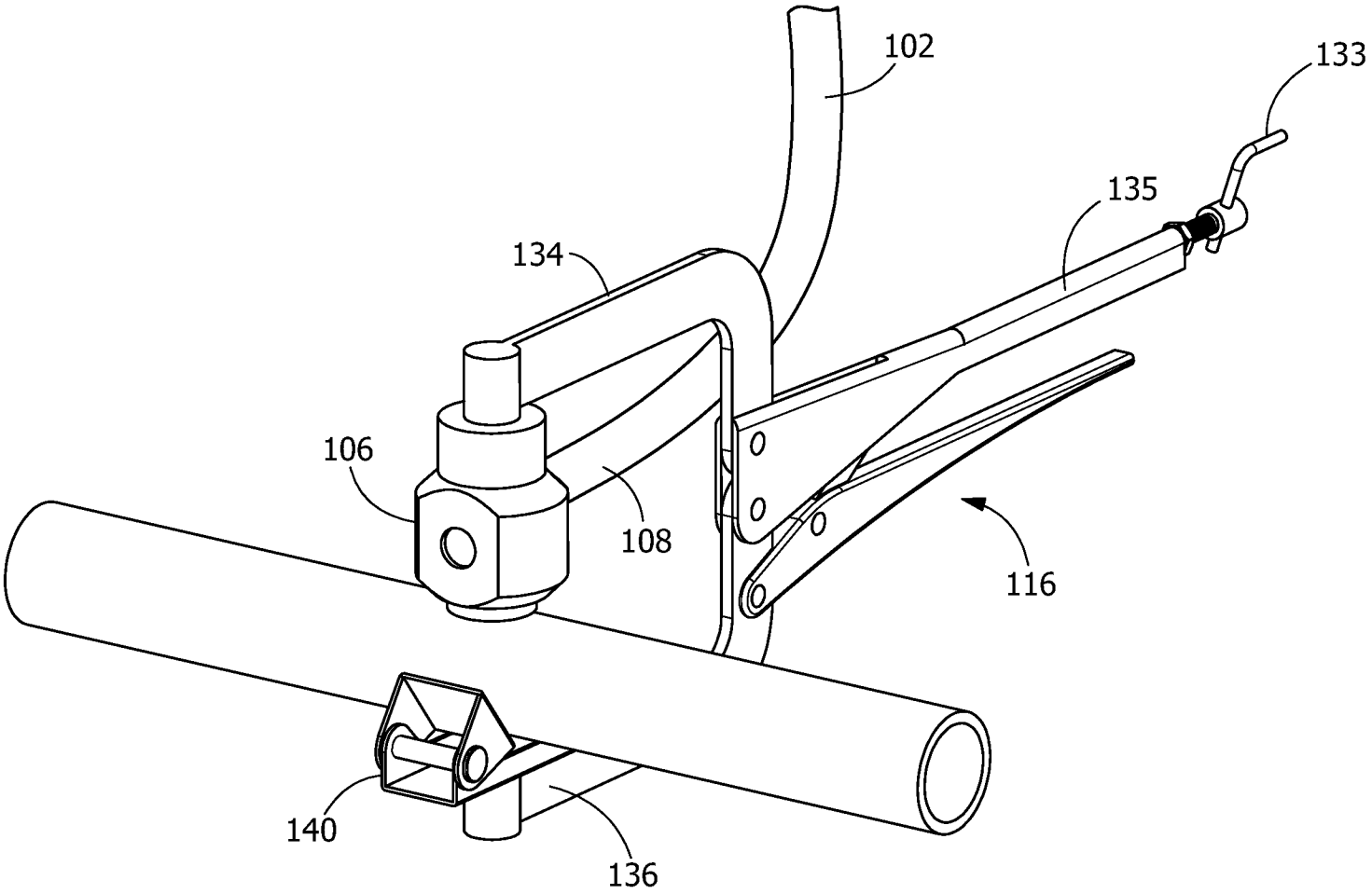
FIG. 3 illustrates a perspective view of an illustrative clamp used to connect to a pipe in the temporary electrical bonding/grounding system.

Referring to FIG. 3, the pipe clamp 116 configured to connect a conductive coupling to a pipe is shown. The pipe clamp 116 and the magnet clamp 118 may be similar, and may in fact be the same clamp, with the post 114 similar in size and shape to a small copper pipe to which clamp 116 would attach. In this regard, the clamps 116, 118 may be selected and designed to be interchangeable. FIG. 3 shows a pipe clamp 116 with the first half 134 and the second half 136 configured to engage and secure a small pipe. The first half 134 includes the first conductive coupling 106 and the second half 136 includes the post saddle 140 for grasping the pipe. The first end 108 of the electrically conductive cable 102 is shown electrically coupled to the first conductive coupling 106 which is affixed to the first half 134 of the pipe clamp 116. A crank or tightening member 133 may be provided on the handle 135 to facilitate the attachment and adjustment of the pipe clamp 116 to pipes of various diameters or sizes.

Figure 4:
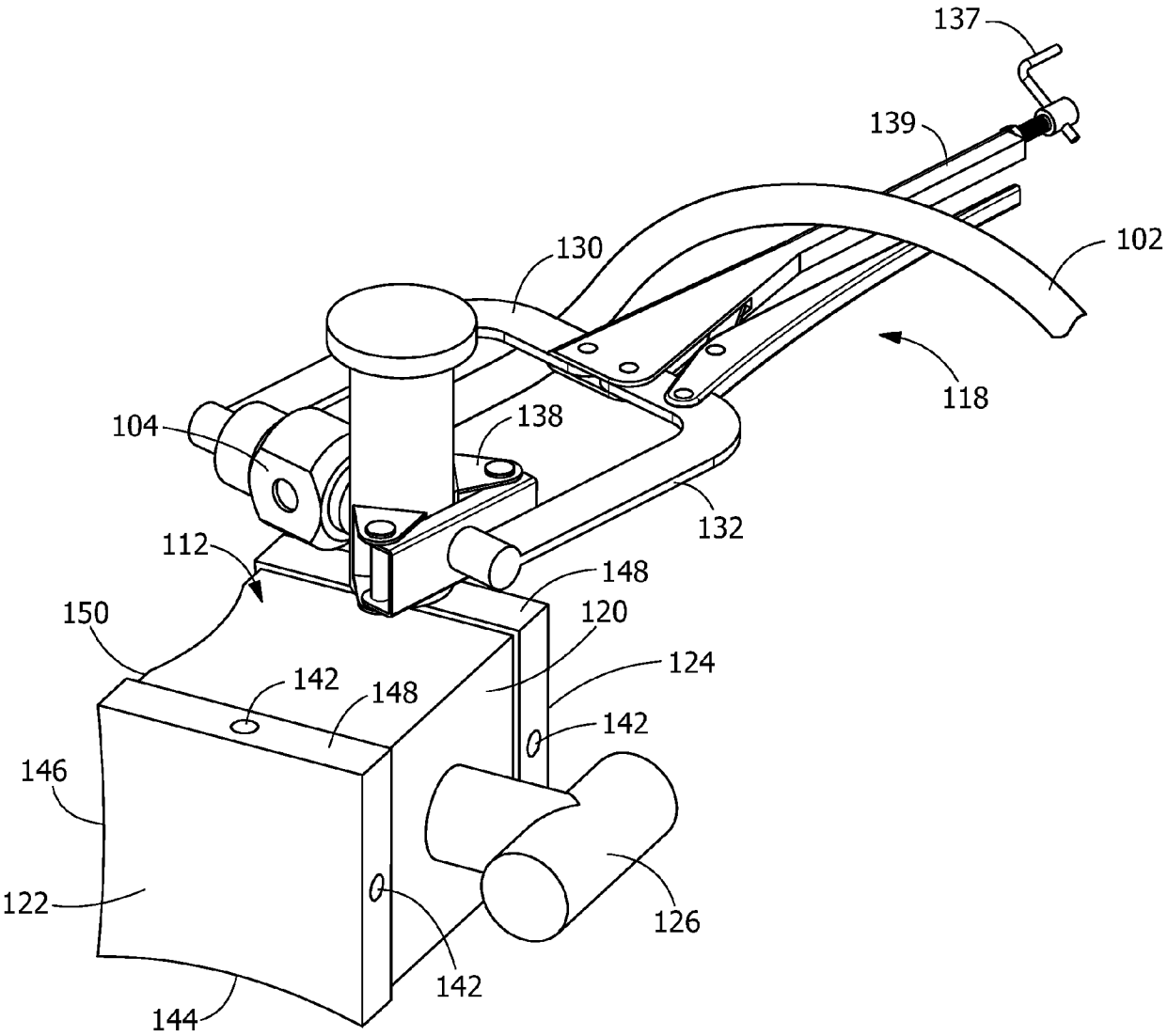
FIG. 4 illustrates a perspective view of an illustrative clamp used to connect to the magnet component in the temporary electrical bonding/grounding system.

Referring to FIG. 4, the magnetic clamp 118 is configured to connect a first conductive coupling 104 to the magnetic component 112 as shown. The magnet clamp 118 includes a first half 130 and a second half 132. The first half 130 secures and retains the first conductive coupling 104 and the second half 132 secures and retains the post saddle 138. The post saddle 138 is configured to grasp the post 114 and hold it against the first conductive coupling 104 when the magnet clamp 118 is closed around the post 114, providing a secure and stable electrical connection between the first conductive coupling 104 and the post 114. The first conductive coupling 104 further includes a connection point 151 for an additional cable connection. A crank or tightening member 137 may be provided on the handle 139 to facilitate the attachment and adjustment of the magnetic clamp 118 to posts 114 of various diameters or sizes.

Figure 5:
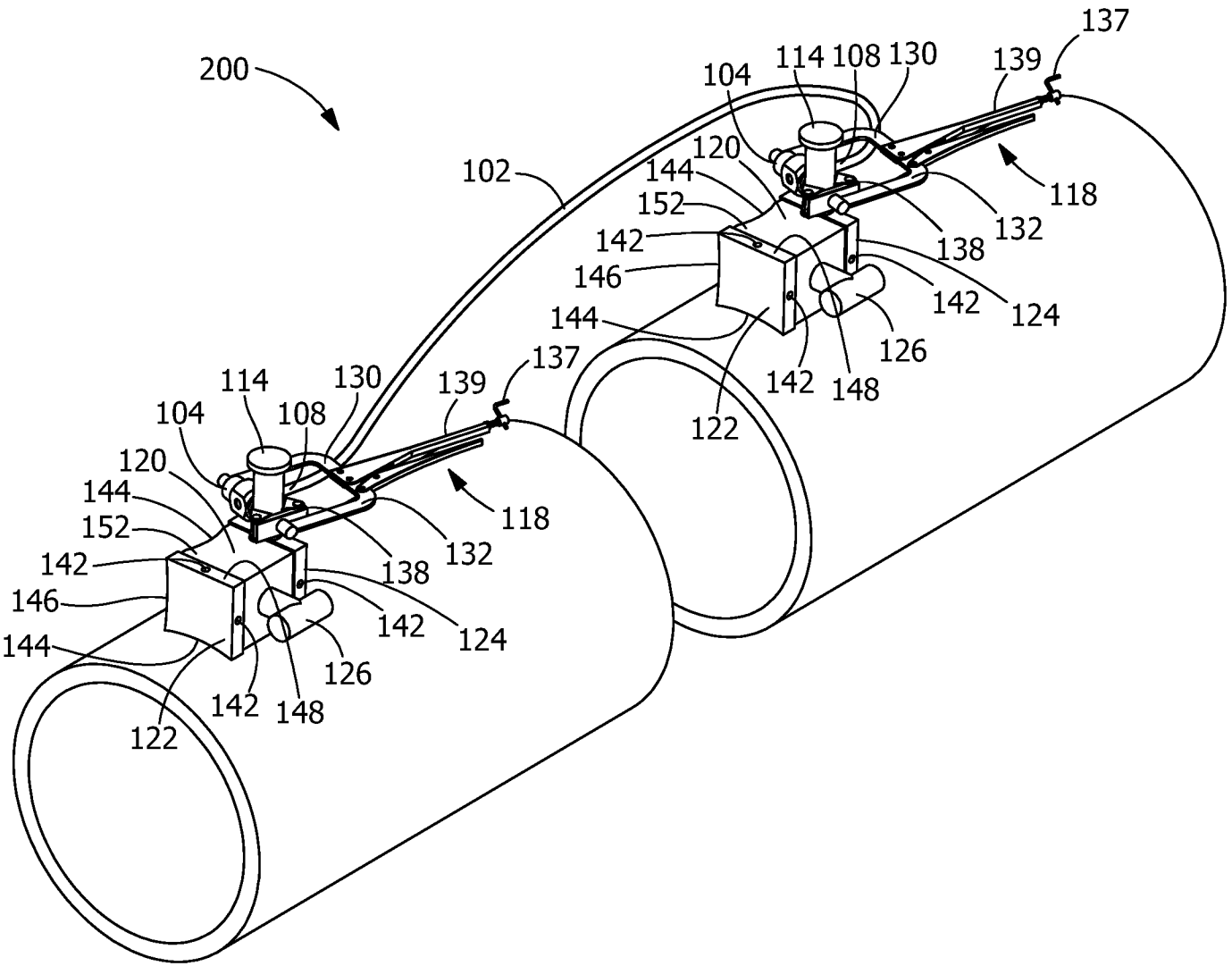
FIG. 5 illustrates a perspective view of the temporary electrical bonding/grounding system comprising having two magnetic components.

Referring to FIG. 5, a second embodiment 200 of the temporary electrical bonding/grounding system is shown. The system includes a first magnetic component 112A and a second magnetic component 112B which are shown electrically coupled to provide an electrical bypass between conductive surfaces of the pipe. The magnetic components 112A, 112B are similar to the magnetic component 112 described above and are coupled together using the first electrically conductive cable 102. As the operation of the magnetic components 112A, 112B are as described above.

Figure 6:
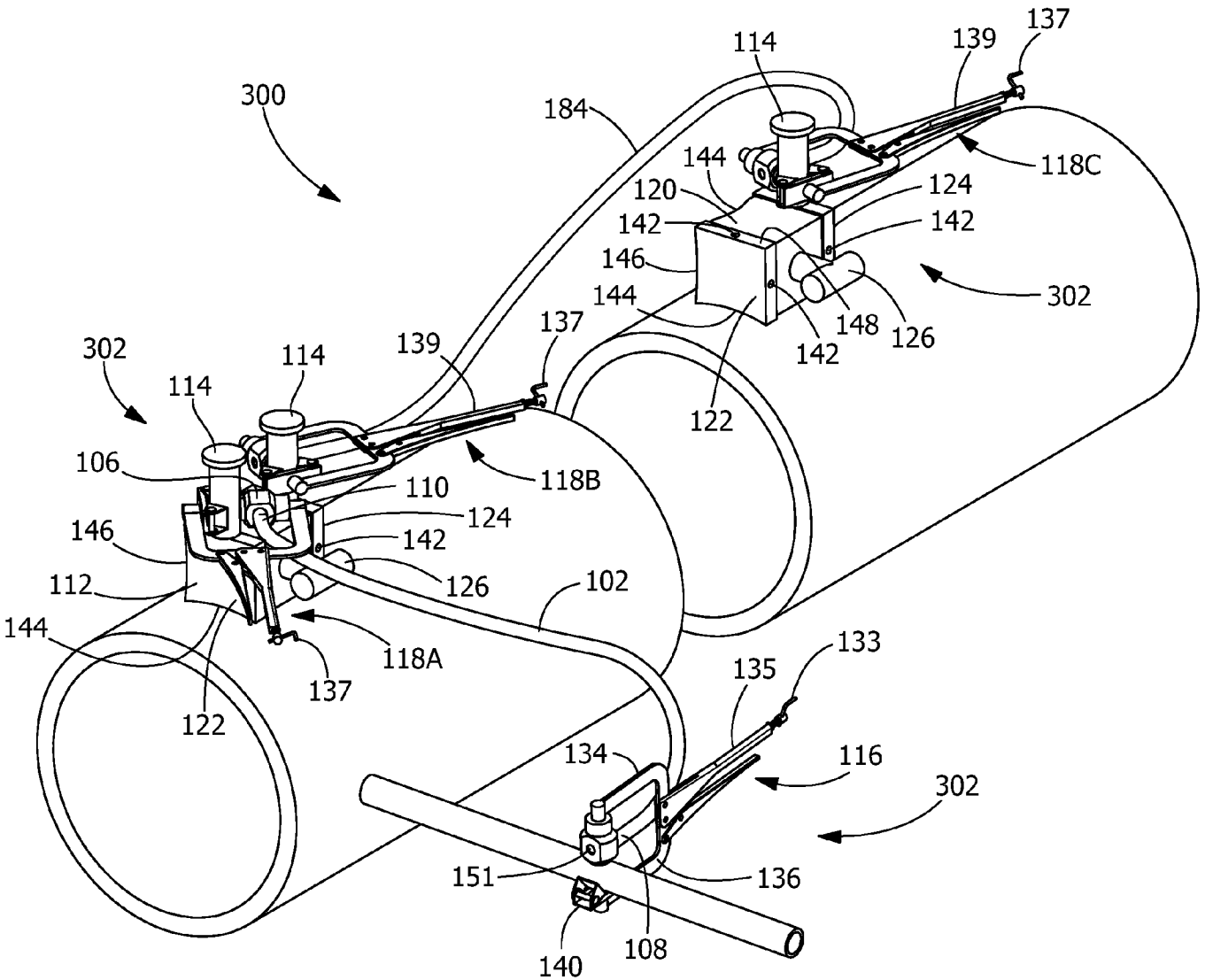
FIG. 6 illustrates a perspective view of the temporary electrical bonding/grounding system having multiple magnetic component and multiple cables.

Referring to FIG. 6, a third embodiment 300 of the temporary electrical bonding/grounding system is shown. In FIG. 6, multiple conductive elements 302 are joined to provide an electrical bypass. Any combination of clamps and magnetic components described herein can be used, and the arrangement shown in FIG. 6 is not limited to the elements shown or only three elements. FIG. 6 depicts one configuration in which a pipe clamp 116 is electrically coupled to a first magnetic clamp 118A through a first electrically conductive cable 102, and a second magnetic clamp 118B is electrically coupled to a third magnetic clamp 118C through a second electrically conductive cable 184.

In use, when attaching to a service line pipe, the following illustrative procedure can be used: i) excavate and expose service line on the house side of a curb stop; ii) clean off service line pipe to bare metal to allow pipe clamp 116 to make metal to metal contact; iii) excavate and expose portion of water main; iv) clean off water main pipe to bare metal to allow magnetic component 112 to be physically and electrically attached to the water main pipe; v) attach pipe clamp 116 to service line pipe and tighten; vi) attach magnetic component 118 to water main pipe; and vii) attach magnetic clamp 118 to post 114 of magnetic component 112 and tighten. Other illustrative procedures, which include additional steps or which install the components in a different order may be used.

In use, when attaching to a water main pipe, the following illustrative procedure can be used: i) excavate and expose water main on both sides of the area to be worked on; ii) clean off water main pipe to bare metal on either side to allow magnetic components 112 to be physically and electrically attached to the water main pipe; iii) attach magnetic components 118 to water main pipe on both sides of the area to be worked on; and iv) attach magnetic clamps 118 to posts 114 of each magnetic component 112 and tighten. Other illustrative procedures, which include additional steps or which install the components in a different order may be used.

In use, when attaching to a service line pipe and a water main pipe, the following illustrative procedure can be used: i) excavate and expose water main on both sides of the area to be worked on; ii) clean off water main pipe to bare metal on either side to allow magnetic components 112 to be physically and electrically attached to the water main pipe; iii) excavate and expose service line on the house side of a curb stop; iv) clean off service line pipe to bare metal to allow pipe clamp 116 to make metal to metal contact; v) attach magnetic components 118 to water main pipe on both sides of the area to be worked on; vi) attach magnetic clamps 118 to posts 114 of each magnetic component 112 and tighten; and vii) attach pipe clamp 116 to service line pipe and tighten. Other illustrative procedures, which include additional steps or which install the components in a different order may be used.

While the invention has been described with reference to a preferred embodiment, it will be understood by those skilled in the art that various changes may be made and equivalents may be substituted for elements thereof without departing from the spirit and scope of the invention of the invention as defined in the accompanying claims. In particular, it will be clear to those skilled in the art that the present invention may be embodied in other specific forms, structures, arrangements, proportions, sizes, and with other elements, materials, and components, without departing from the spirit or essential characteristics thereof. One skilled in the art will appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

The invention claimed is:

1. An apparatus for providing a temporary electrical bonding/grounding connection, the apparatus comprising:

an electrically conductive cable having first and second ends;

a first conductive coupling electrically coupled to the first end of the cable and a first magnetic assembly;

the magnet assembly including multiple surfaces having a different radius of curvature, a respective surface of the multiple surfaces cooperates with an arcuate surface of a first conductive pipe to be grounded, the magnetic assembly detachably and electrically coupled to the first conductive coupling, the magnetic assembly configured to be electrically and magnetically coupled to the first conductive pipe; and a second conductive coupling electrically coupled to the second end of the cable, the second conductive coupling configured to be detachably and electrically coupled to a second conductive surface.

2. The apparatus as recited in claim 1, wherein the magnetic assembly includes a magnet and shoes, the shoes provided at either end of the magnet.

3. The apparatus as recited in claim 2, wherein each of the shoes has a first curved surface, a second curved surface, and third curved surface, the first curved surfaces of each of the shoes of the magnetic assembly are positioned to extend in the same direction, the second curved surfaces of each of the shoes of the magnetic assembly are positioned to extend in the same direction, which is in a different direction that the first curved surfaces, the third curved surfaces of each of the shoes of the magnetic assembly are positioned to extend in the same direction, which is in a different direction that the first curved surfaces and the second curved surface.

4. The apparatus as recited in claim 3, wherein the first, second and third curved surfaces have different contours or radius of curvature, thereby allowing the first, second and third curved surfaces to engage and make electrical connection with different sized arcuate surfaces.

5. The apparatus as recited in claim 2, wherein the shoes are made from material which is attracted to the magnet, thereby facilitating the physical and electrical connection between the shoes and the magnet.

6. The apparatus as recited in claim 2, wherein the shoes are fixed to the magnets.

7. The apparatus as recited in claim 3, wherein openings are provided on the shoes, the openings are positioned on multiple side surfaces of the shoes, the openings are dimensioned to receive a conductive post therein, the post configured to make the mechanical and electrical engagement with the first conductive coupling, the openings allow for the proper positioning and insertion of the post into a respective opening regardless of which of the curved surface is placed in engagement with the arcuate surface of a first conductive surface.

8. The apparatus as recited in claim 7, wherein the openings are threaded.

9. A bonding/grounding system to prevent workers from being exposed to stray electrical current in conductive piping, the system comprising:

an electrically conductive cable having first and second ends;

a first conductive coupling of the conductive cable configured to be electrically coupled to a magnetic assembly;

the magnetic assembly including a removable conductive post which is dimensioned to receive the first conductive coupling, the magnetic assembly configured to be electrically and magnetically coupled to a first conductive surface of the conductive piping;

a second conductive coupling of the conductive cable configured to be electrically coupled to a second conductive surface of the conductive piping;

wherein the temporary electrical bonding/grounding system allows stray electrical current in the conductive piping to pass through the conductive cable, the magnetic assembly, the first conductive coupling and the second conductive coupling to allow the stray electrical current to bypass an area of the conductive piping to be worked on.

10. The bonding/grounding system as recited in claim 9, wherein the magnetic assembly has multiple surfaces which cooperate with the first conductive surface of the conductive piping.

11. The bonding/grounding system as recited in claim 10, wherein the magnetic assembly includes a magnet and shoes, the shoes provided at either end of the magnet.

12. The bonding/grounding system as recited in claim 11, wherein each of the shoes has the multiple surfaces provided thereon, the multiple surfaces include a first curved surface, a second curved surface, and third curved surface, the first curved surfaces of each of the shoes of the magnetic assembly are positioned to extend in the same direction, the second curved surfaces of each of the shoes of the magnetic assembly are positioned to extend in the same direction, which is in a different direction that the first curved surfaces, the third curved surfaces of each of the shoes of the magnetic assembly are positioned to extend in the same direction, which is in a different direction that the first curved surfaces and the second curved surface.

13. The bonding/grounding system as recited in claim 12, wherein the first, second and third curved surfaces have different contours or radius of curvature, thereby allowing the first, second and third curved surfaces to engage and make electrical connection with different sized arcuate first conductive surfaces.

14. The bonding/grounding system as recited in claim 11, wherein the shoes are made from material which is attracted to the magnet, thereby facilitating the physical and electrical connection between the shoes and the magnet.

15. The bonding/grounding system as recited in claim 11, wherein openings are provided on the shoes, the openings are positioned on multiple side surfaces of the shoes, the openings are dimensioned to receive the removable conductive post therein.

16. The bonding/grounding system as recited in claim 15, wherein the openings are threaded.

17. A bonding/grounding system to prevent workers from being exposed to stray electrical current in conductive piping, the system comprising:

an electrically conductive cable having first and second ends;

a first conductive member of the conductive cable configured to be electrically coupled to a magnetic assembly;

the magnetic assembly including multiple surfaces having a different radius of curvature, a respective surface of the multiple surfaces cooperates with an arcuate surface of a first conductive pipe to be grounded, the first magnetic component detachably coupled to the first conductive coupling, the magnetic assembly configured to be electrically and magnetically coupled to the first conductive pipe, the magnetic assembly including a removable post which can be positioned in different locations depending upon the orientation of the magnetic assembly relative to the first conductive pipe, the post is dimensioned to receive the first conductive coupling;

a second conductive member of the conductive cable configured to be detachably and electrically coupled to a second conductive surface;

wherein the temporary electrical bonding/grounding system allows stray electrical current in the conductive piping to pass through the conductive cable, the magnetic assembly, the first conductive coupling and the second conductive coupling to allow the stray electrical current to bypass an area of the conductive piping to be worked on.

18. The bonding/grounding system as recited in claim 17, wherein the magnetic assembly includes a magnet and shoes, the shoes provided at either end of the magnet.

19. The bonding/grounding system as recited in claim 18, wherein each of the shoes has the multiple surfaces provided thereon, the multiple surfaces include a first curved surface, a second curved surface, and third curved surface, the first curved surfaces of each of the shoes of the magnetic assembly are positioned to extend in the same direction, the second curved surfaces of each of the shoes of the magnetic assembly are positioned to extend in the same direction, which is in a different direction that the first curved surfaces, the third curved surfaces of each of the shoes of the magnetic assembly are positioned to extend in the same direction, which is in a different direction that the first curved surfaces and the second curved surface.

20. The bonding/grounding system as recited in claim 18, wherein openings are provided on the shoes, the openings are positioned on multiple side surfaces of the shoes, the openings are dimensioned to receive a conductive post therein, the post configured to make the mechanical and electrical engagement with the first conductive coupling, the openings allow for the proper positioning and insertion of the post into a respective opening regardless of which of the curved surface is placed in engagement with the arcuate surface of a first conductive member.

* * * * *